US009194141B2

(12) United States Patent
Saunders

(10) Patent No.: US 9,194,141 B2
(45) Date of Patent: Nov. 24, 2015

(54) WEATHER STRIP BUTTON

(71) Applicant: Milgard Manufacturing Incorporated, Taylor, MI (US)

(72) Inventor: Melvin Saunders, Auburn, WA (US)

(73) Assignee: MILGARD MANUFACTURING INCORPORATED, Tacoma, WA (US)

( * ) Notice: Subject to any disclaimer, the term of this patent is extended or adjusted under 35 U.S.C. 154(b) by 0 days.

(21) Appl. No.: 14/211,854

(22) Filed: Mar. 14, 2014

(65) Prior Publication Data

US 2014/0265141 A1 Sep. 18, 2014

Related U.S. Application Data

(60) Provisional application No. 61/793,527, filed on Mar. 15, 2013.

(51) Int. Cl.

| | |
|---|---|
| ***E04C 2/38*** | (2006.01) |
| ***E04G 23/02*** | (2006.01) |
| ***E06B 1/68*** | (2006.01) |
| ***E06B 3/96*** | (2006.01) |

(52) U.S. Cl.

CPC ..... *E04G 23/0277* (2013.01); *E06B 1/68* (2013.01); *E06B 3/9608* (2013.01)

(58) Field of Classification Search

CPC ..... E04G 23/0277; E06B 1/68; E06B 3/9608
USPC ..... 52/656.9
See application file for complete search history.

(56) References Cited

U.S. PATENT DOCUMENTS

| | | | | |
|---|---|---|---|---|
| 3,448,784 | A | 6/1969 | Sons | |
| 3,466,819 | A * | 9/1969 | Giger | 52/1 |
| 3,765,282 | A | 10/1973 | Crain | |
| 4,540,035 | A | 9/1985 | Roberts | |
| 6,332,490 | B1 | 12/2001 | Griggs | |
| 7,730,679 | B2 * | 6/2010 | Eckenswiller et al. | 52/209 |
| 8,584,411 | B2 * | 11/2013 | Mitchell | 52/209 |
| 2001/0034932 | A1 | 11/2001 | Macdonald | |
| 2008/0196342 | A1 * | 8/2008 | Franklin | 52/309.1 |
| 2009/0199495 | A1 | 8/2009 | Garries et al. | |

* cited by examiner

*Primary Examiner* — Mark Wendell
(74) *Attorney, Agent, or Firm* — Rathe Lindenbaum LLP

(57) ABSTRACT

A weather-stripping repair includes a base having a top surface and an opposing bottom surface. The top surface area being greater than the distance between the top surface and bottom surface. A cylindrical peg extends from the bottom surface. A weather strip material extends from the top surface.

19 Claims, 5 Drawing Sheets

WEATHER STRIP BUTTON

CROSS-REFERENCE TO RELATED PATENT APPLICATIONS

This application claim priority to U.S. Provisional Application No. 61/793,527 entitled Button Repair Weather-Stripping filed Mar. 15, 2013 and incorporated herein by reference in its entirety.

BACKGROUND

Fenestration assemblies include doors, windows and screen members. Weather stripping material is used to provide a weather tight seal between the outside and inside of a structure adjacent the fenestration assembly.

SUMMARY OF THE INVENTION

In one embodiment a weather-stripping repair includes a base having a top surface and an opposing bottom surface. The top surface area being greater than the distance between the top surface and bottom surface. A cylindrical peg extends from the bottom surface. A weather strip material extends from the top surface.

In another embodiment a fenestration assembly includes a frame having a channel including at least a first linear weather strip material, the channel having at least one corner. A weather strip button has a non-linear shape and is located within the channel at the at least one corner and immediately adjacent the at least first linear weather strip material.

A method for repairing damaged area weather-stripping in a fenestration assembly, comprising removing a portion of a linear weather stripping material in a corner of a frame member of a fenestration assembly. The method also includes providing a weather strip button including a base having a top surface and an opposing bottom surface and a cylindrical peg extending from the bottom surface. The peg is inserted into the aperture that provides a continuous weather strip surface between the weather strip button and the adjacent linear weather stripping material.

DETAILED DESCRIPTION OF THE EXAMPLE EMBODIMENTS

Figure 1:
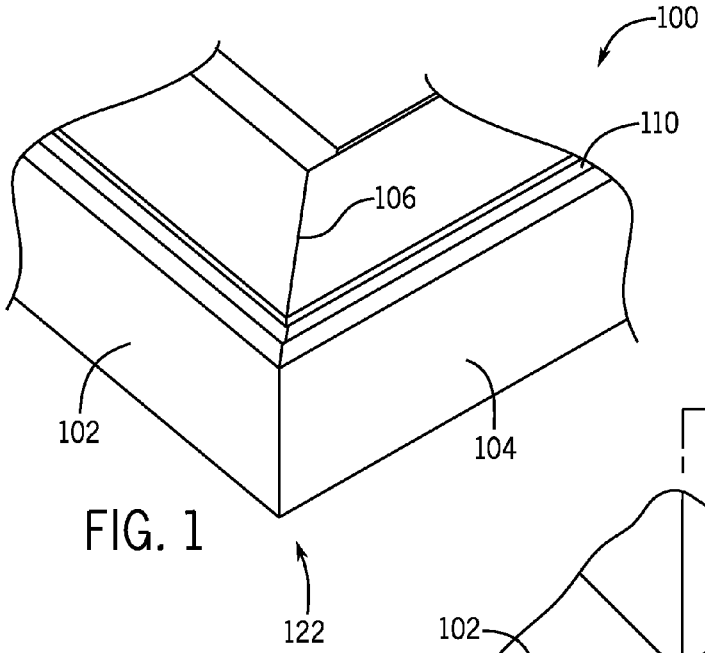
FIG. 1 is a corner portion of a sash.
Figure 2:
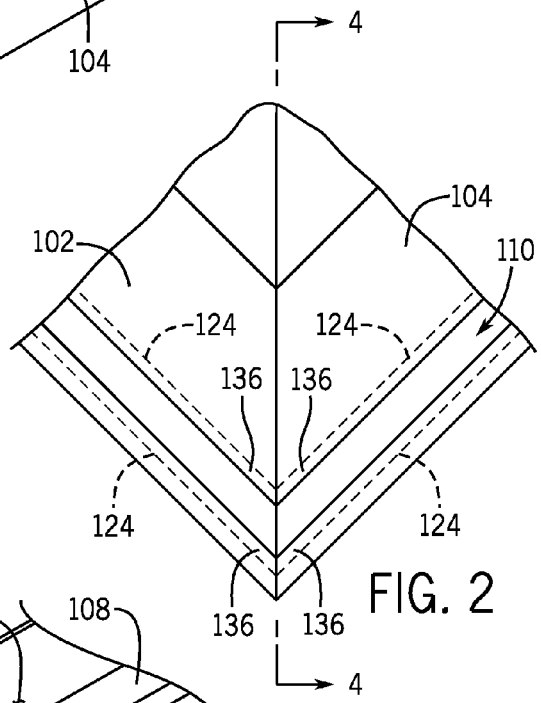
FIG. 2 is a top view of the corner portion of FIG. 1
Figure 3:
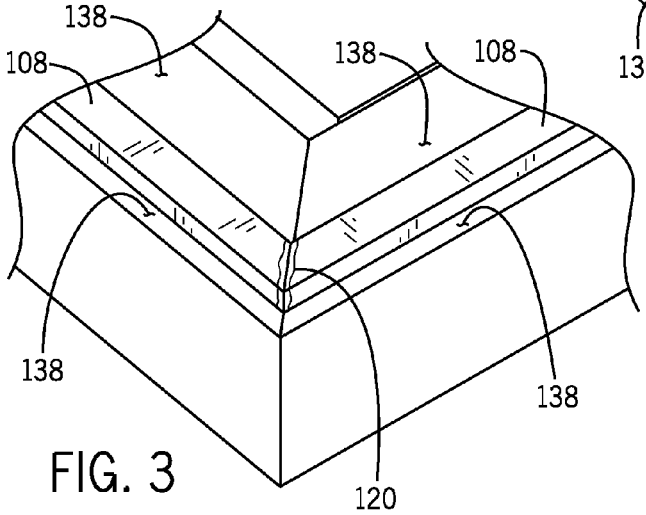
FIG. 3 is the corner portion of FIG. 1 showing an area of interest.

Referring to FIGS. 1-3, a portion of sash 100 in a fenestration assembly includes a first lineal member 102 and a second lineal member 104 that is connected together along a miter seam 106. A weather stripping material 108 is positioned within a T-shaped channel 110 such that a base 112 of weather stripping material 108 is positioned within a first lateral portion 114 of channel 110 and the pile or weather strip material 116 extending from base 112 extends through a second portion 118 of channel 110. The second portion 118 has a perpendicular orientation to first lateral portion 114.

Referring to FIG. 2, the lateral edges 124 of lateral portion 114 of channel 110 are shown as a hidden broken lines. In one embodiment a lateral weather strip 108 members are placed in a respective T-channel 110 through an open end of respective sash lateral portions 102 and 104 prior to the sash lateral portions 102, 104 being welded together. Once the lateral sash strips are placed together in a jig, they are heat welded together forming a miter seam 106. During the welding process a portion of the weather strip material 108 may be damaged proximate the miter seam 106. In operation a sash may include four lineal members forming a rectangular shape. One corner 122 of sash 100 is illustrated in FIG. 1, though three or more corners may be present depending on the shape of the sash and the number of lineal members being assembled.

Referring to FIG. 3 the damaged portion of weather strip material 108 is identified as region 120. The damaged area 120 of the weather strip materials 108 may occur when sash lineal members 102 and are welded and/or during a subsequent cleaning operation to remove any flash material at seam 106. As a result of the damaged area 120 the weather-strip 108 does not form a continuous seal around the sash 100. It is also possible that damaged area 120 may occur in the field during normal use by an operator and/or damage by weather elements.

Figure 4:
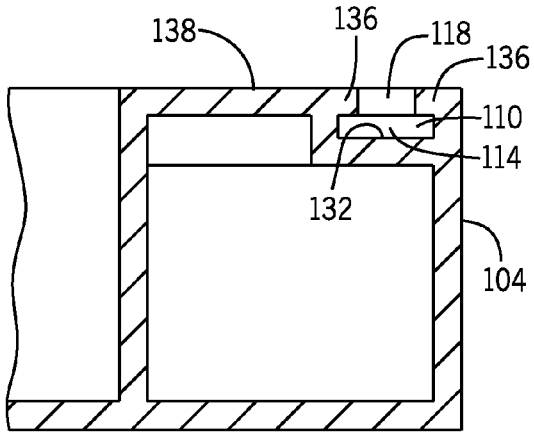
FIG. 4 is a cross-sectional view of the window frame of FIG. 1 taken generally along lines 4-4 of FIG. 2.

Referring to FIGS. 3 and 4, although not shown, weather strip material 108 has a base portion that is positioned within the lateral portion 114 of channel 110. A pile or other suitable weather strip material known in the art extends from the base up through the vertical channel 118 and extends beyond the surface 138 of the sash lineal member in a direction away from the floor 132 of lateral channel portion 114. In one embodiment, the base portion of the weather strip material 108 has a width that is greater than the weather strip material pile that extends from the base.

Figure 5:
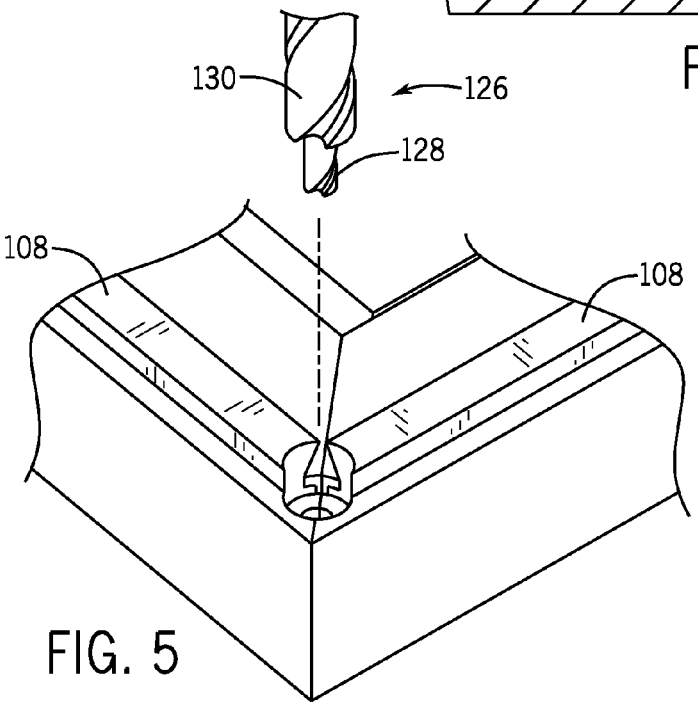
FIG. 5 is an isometric view of a drill bit removing a portion of the sash and weather stripping.

Referring to FIG. 5 the damaged region 120 may be removed with a punch and/or drill 126 having a given shape. In one embodiment drill 126 is a two stage drill having a first portion 128 with a first diameter and a second portion 130 having a second diameter that is larger than the first diameter of the first portion 128. However other punch shapes are also contemplated. For example a punch could be an L-shape punch that remove a portion of the sash forming an L shape with one leg of the L being collinear with the channel 110 of the first sash lineal member 102 and the second leg of the L-shape portion being co-lineal with the channel 110 of the second sash lineal member 104.

The first portion 128 of drill 126 drills through the weather strip material 108 in the region 120 and continues to drill through a floor 132 of channel 110 forming an aperture 134 there through. Second portion 130 of drill 126 removes a larger region of the weather strip material 108 and further removes portions 136 of sash lineal members 102 and 104 that covered channel 110.

Figure 6:
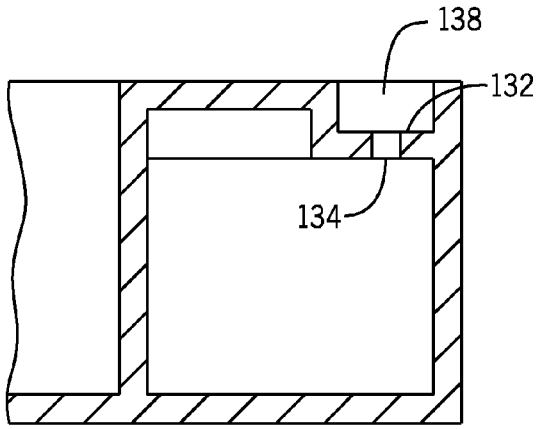
FIG. 6 is a cross-sectionals view of the window frame with a portion of the sash removed.

Referring to FIG. 6, once drill 126 has removed portion 136 and drilled the aperture into the base 132 a cavity 138 exists to receive a button 140. Button 140 has a main body portion 140 and a plug or extension portion 142 extending from a bottom of main body portion 140. Button body portion 140 may be made of a plurality of fibers extending from the base of button 140 or may be a solid material having suitable characteristics to provide weather sealing for the sash. Button 140 includes an upper surface 146 that is the free terminal ends of the weather strip materials such as fibers or may be the upper surface of a solid weather strip material.

Figure 7:
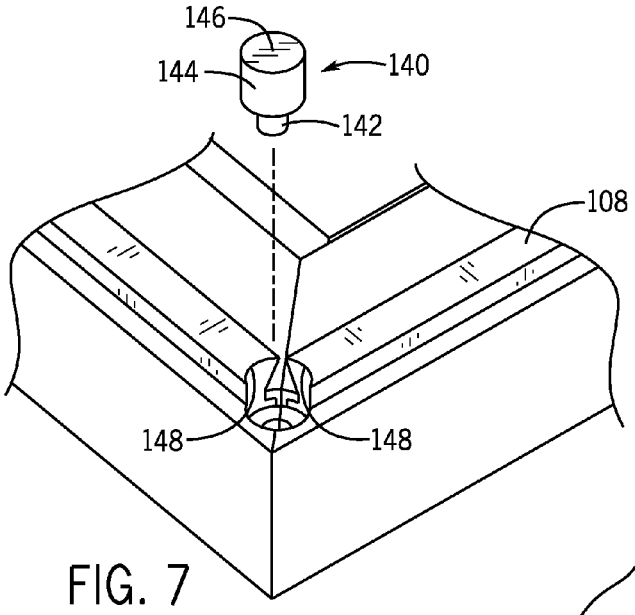
FIG. 7 is an isometric view of a button being installed into the sash with the portion of the window frame removed.
Figure 8:
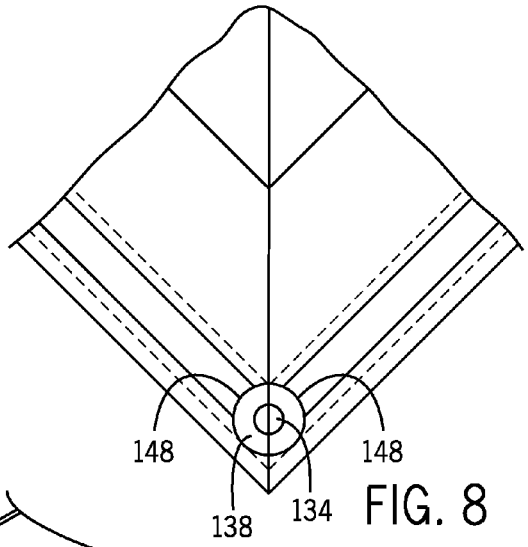
FIG. 8 is a top view of a corner portion of sash prior to the button being installed.
Figure 9:
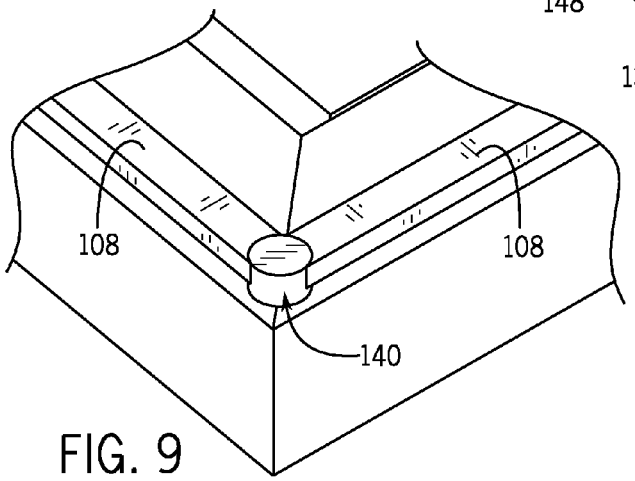
FIG. 9 is an isometric view of the corner portion of the sash with the button installed.

Referring to FIG. 7, button 146 is inserted into opening until peg 142 is positioned within aperture 134. In one embodiment peg 142 includes a snap fit features such as a ridge or other known snap fit features that allow the button to be snap fit into aperture 134. In one embodiment, the button may be removed from aperture 132 with some force applied to the button sufficient to overcome the snap fit feature. The adjacent lineal weather strip materials 108 include an arcuate shape 148 proximate opening 138. The arcuate shape 148 was created by the drill 126. In one embodiment the diameter of main body portion 144 of button 140 is greater than the diameter of drill bit portion 130. Referring to FIG. 9, the lineal weather strips 108 and the button 140 provide a continuous weather strip material for sash 100.

Figure 10:
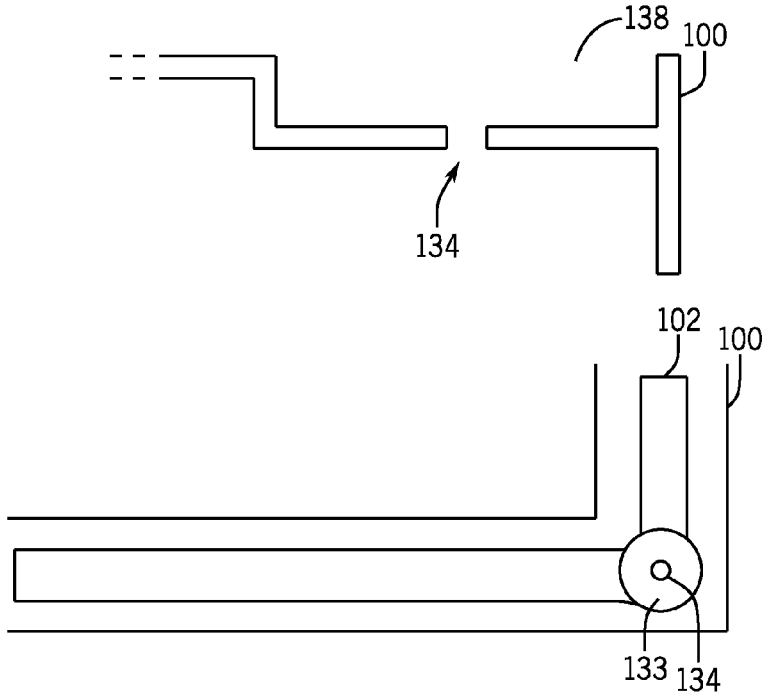
FIG. 10 is cross sectional and top plan view of a portion of the sash after a portion of the sash has been removed.
Figure 11:
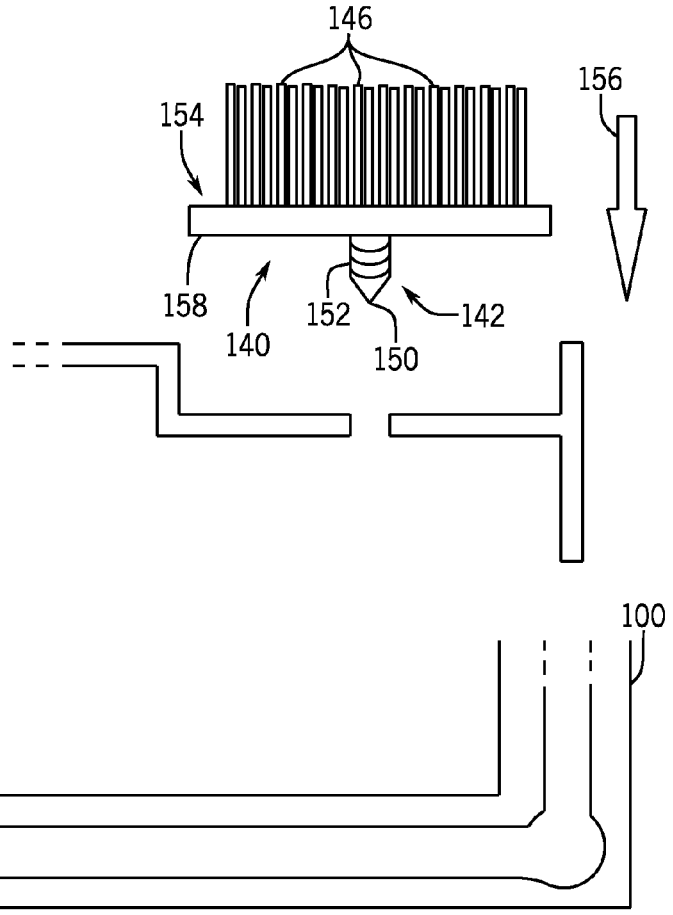
FIG. 11 is a side and top view of a weather button in position to be mounted or attached.
Figure 12:
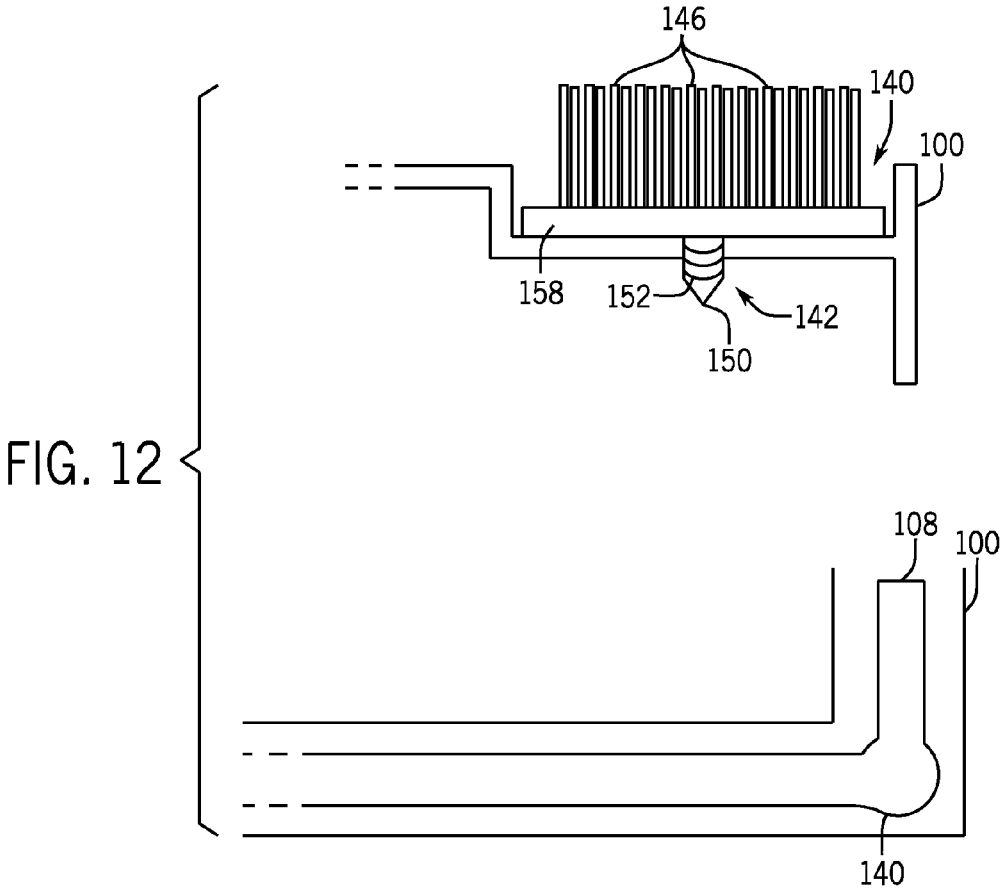
FIG. 12 is a side and top view of a weather button attached to a sash.

Referring to FIGS. 10-12, the process of installing a button 140 will be described. Once the button receiving opening 138 and aperture 134 is created as discussed above button 140 is inserted into opening 138 in a direction 156. In one embodiment peg 142 may include one or more radially extending circumferential ribs that have a larger diameter than opening 134. Since the peg and/or sash 100 may be a plastic or vinyl material the radially extending ribs may be forced through opening 134 to provide a snap fit attachment of button 140 to sash 100.

Button 140 includes a base member 154 with pile 146 extending upwardly from the base member 154 in a direction opposite peg 142. In one embodiment, the width of the cumulative group of pile 146 is less than the width or diameter of base 154. However in another embodiment the width of the cumulative group of pile 146 or main body portion 144 is equal to the width of base 154. In another embodiment pile 146 extends upwardly and outwardly from base 154 such that the top portion 146 has a diameter greater than the base 154.

In one embodiment peg 142 may have a pointed portion 150 to assist in the placement of the peg and button within aperture 134. In another embodiment drill or punch 126 is a single step drill having a single diameter or cross-sectional shape that does not create an aperture 134 in sash 100. In this embodiment, button may have an adhesive material on a bottom portion 158 of base 154. In this embodiment the button is adhesively attached to the button of opening 138. In this manner no aperture in opening 138 is required. In such an embodiment no peg is required as well.

The peg 1142 is normally mounted at a geometric center to the bottom 158 of base 154. However, in other embodiments, there may be more than one peg 142. For example, surface areas that have a high length to width ratio, may have a second peg (not shown), or as many as are needed, attached to the bottom 158 of the base 154 to provide better stability and adhesion to the sash 100. In one embodiment, at least one rib 152 is formed around a circular perimeter of the peg 142. These ribs 152 provide a removably snug fit for the weather-strip button 140 when inserted into the aperture 134. In addition, other methods of snug replacement attachment (not shown) are available such as weak glue, a screw fittings, etc. can be used. In one embodiment peg 122 may have a bottom key portion that fits within a matching irregular key shape in aperture 134. Once the button is inserted into the aperture 134 it may be rotated to prevent button 140 from being removed from aperture 134 without first rotating button 140 to align the key shape features.

Pile 146 normally matches the surrounding weather-stripping 108. In terms of coverage, the pile 146 covers the majority of the top surface of base 154. In the embodiment shown in FIGS. 3 and 4, 95% of the base 154 will have replacement pile 146. This may be sufficient if pile 146 is of such a nature as to extend radially outwardly. However, pile 146 may extend over the entire base 154 to provide sufficient amount of button pile 146 to sufficiently integrate with surrounding healthy/undamaged pile or weather-stripping 108. The pile 146 may any known type of weather stripping material known in the art and may be the same or different material than the upper surface of the lineal weather stripping material 108. As discussed above, in one embodiment the pile 146 extends radially upwardly and outwardly from the base such that the top portions of pile 146 extend beyond the circumference of the base.

For these and other embodiments of this invention, snap-fit or snap-fitting is defined as:

A mechanical joint system where part-to-part attachment is accomplished with locating and locking features (constraint features) that are homogenous with one or the other of the components being joined. Joining requires the (flexible) locking features to move aside for engagement with the mating part, followed by return of the locking feature toward its original position to accomplish the interference required to latch the components together. Locator features, the second type of constraint feature, are inflexible, providing strength and stability in the attachment. Enhancements complete the snap-fit system, adding robustness and user-friendliness to the attachment.

It is important to note that the construction mechanism as described herein is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements and vice versa, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the exemplary embodiments without departing from the scope of the present inventions as expressed in the appended claims.

What is claimed is:

1. A fenestration assembly comprising:

a frame having a channel including at least a first linear weather strip material, the frame having at least one corner; and a weather strip button having a non-linear shape and comprising a main body portion including a button weather strip material and a base having a top surface and a bottom surface wherein the button weather strip material extends from the top surface of the base, the weather strip button being located within the channel at the at least one corner and immediately adjacent the at least first linear weather strip material providing a continuous weather strip.

2. The fenestration assembly of claim 1, wherein the weather strip button further includes a cylindrical peg extending from the bottom surface of the base and being received into an aperture in the frame at the corner.

3. The fenestration assembly of claim 2, wherein the peg includes a threaded portion that is threadably received within the aperture.

4. The fenestration assembly of claim 2, wherein the peg has a pointed end.

5. The fenestration assembly of claim 2, wherein the peg contains at least one rib circularly attached to the peg.

6. The fenestration assembly of claim 2, wherein the peg includes at least one barb configured to prevent the base from being removed from the aperture.

7. The fenestration assembly of claim 2, wherein the peg has a helicoid on an outer surface of the peg.

8. The fenestration assembly of claim 2, wherein the base has one or more additional peg(s) attached.

9. The fenestration assembly of claim 2, wherein the peg extends from the base offset from a geometric center of the bottom surface of the base.

10. The fenestration assembly of claim 1, wherein the button weather strip material is the same weather strip material as the first linear weather strip material.

11. The fenestration assembly of claim 10, wherein the weather strip button is snap fit into the aperture of the frame.

12. The fenestration assembly of claim 11, further including a second linear weather strip material, the first linear weather strip material and the second linear weather strip material each having a terminal end adjacent the weather strip button.

13. The fenestration assembly of claim 12, wherein the peg includes a member that has a larger cross section than the aperture and is able to snap-fit into place by inserting the peg into an aperture of a frame member.

14. The fenestration assembly of claim 1, wherein the base is arcuate.

15. The fenestration assembly of claim 1, wherein the base is rectangular.

16. The fenestration assembly of claim 1, wherein the top surface has a width greater than a distance between the top surface and the bottom surface.

17. The fenestration assembly of claim 1, wherein the first linear strip material includes a first terminal end having a first arcuate section that mates with a first arcuate portion of the weather strip button.

18. The fenestration assembly of claim 17, further including a second linear strip material including a second terminal end having a second arcuate section that mates with a second arcuate potion of the weather strip button.

19. The fenestration assembly of claim 1, wherein the frame includes a first frame member, the channel being at least partially within the first frame member, the first linear weather strip being in the first frame member and the weather strip button being at least partially within the first frame member.

* * * * *